US011286637B2

(12) United States Patent
Stetter et al.

(10) Patent No.: US 11,286,637 B2
(45) Date of Patent: Mar. 29, 2022

(54) TRENCH CUTTER AND METHOD FOR PRODUCING A CUT TRENCH IN THE SOIL

(71) Applicant: BAUER Maschinen GmbH, Schrobenhausen (DE)

(72) Inventors: Dieter Stetter, Aichach (DE); Sebastian Christoph Bauer, Schrobenhausen (DE); Leonhard Weixler, Thierhaupten (DE); Ulli Wiedenmann, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 276 days.

(21) Appl. No.: 16/383,708

(22) Filed: Apr. 15, 2019

(65) Prior Publication Data

US 2019/0323200 A1 Oct. 24, 2019

(30) Foreign Application Priority Data

Apr. 18, 2018 (EP) ..... 18167973

(51) Int. Cl.
*E02F 3/10* (2006.01)
*E02F 3/24* (2006.01)

(52) U.S. Cl.
CPC ..... *E02F 3/248* (2013.01); *E02F 3/10* (2013.01)

(58) Field of Classification Search
CPC ... E02F 3/205; E02F 3/246; E02F 3/26; E02F 3/9237; E02F 3/248; E02F 3/10; E02D 17/13; F16H 1/32
See application file for complete search history.

(56) References Cited

U.S. PATENT DOCUMENTS 3,710,878 A * 1/1973 Endo ..... E21B 11/06 175/66
4,397,106 A * 8/1983 MdDowell ..... E02F 3/248 37/329

(Continued)

FOREIGN PATENT DOCUMENTS

DE 4141629 A1 6/1993
EP 0249555 A1 12/1987

(Continued)

OTHER PUBLICATIONS

European Search Report issued by the European Patent Office dated Jun. 5, 2018, which corresponds to European Patent Application No. 18 16 7973.

(Continued)

*Primary Examiner* — Jessica H Lutz
(74) *Attorney, Agent, or Firm* — Studebaker & Brackett PC

(57) ABSTRACT

The invention relates to a trench cutter for producing a cut trench in the soil with a cutter frame, at least one pair of cutting wheels which are supported and driven in a rotatable manner on a lower end of the cutter frame, wherein each cutting wheel has a plurality of cutting teeth along its external circumference, and a discharge means with at least one discharge pump for discharging a cutting fluid from the cut trench in the region of the cutting wheels. According to the invention a switchover means is provided which is designed for switching the discharge means over to a flushing operation, in which a fluid flow generated by at least one discharge pump of the discharge means is generated onto at least one cutting wheel for flushing out the cutting wheel.

13 Claims, 8 Drawing Sheets

(56) References Cited

U.S. PATENT DOCUMENTS

Figure 1:
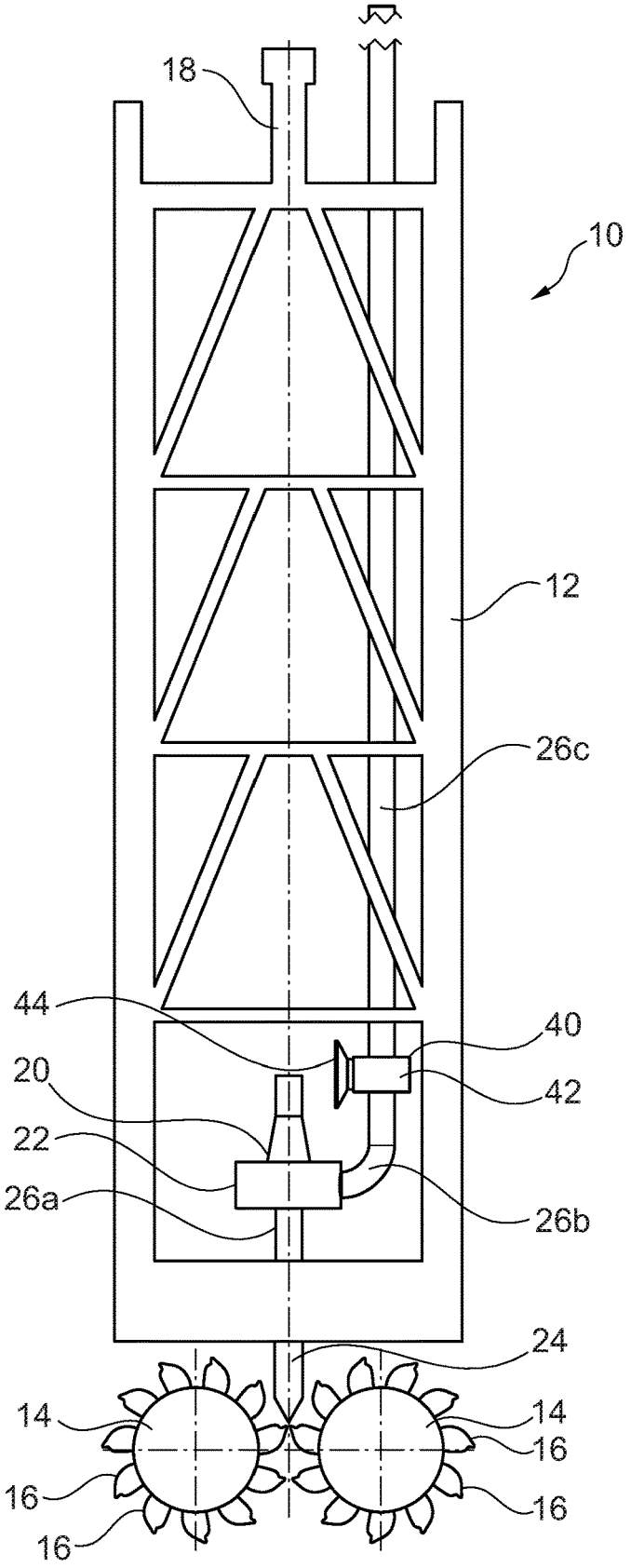

| | | | | |
|---|---|---|---|---|
| 4,694,915 | A * | 9/1987 | Bauer | E02F 3/9237 175/91 |
| 4,744,425 | A * | 5/1988 | Hentschel | E02F 3/205 175/73 |
| 6,860,042 | B2 * | 3/2005 | Hutchinson | E02F 3/40 37/317 |
| 7,591,514 | B2 * | 9/2009 | Chagnot | E02F 3/205 299/78 |
| 2003/0037464 | A1 * | 2/2003 | Gessay | E02F 3/188 37/189 |
| 2006/0039759 | A1 * | 2/2006 | Arzberger | E02D 17/13 405/266 |
| 2009/0022584 | A1 * | 1/2009 | Braghittoni | E02D 19/18 415/206 |

FOREIGN PATENT DOCUMENTS

| | | | |
|---|---|---|---|
| EP | 0253726 | A1 | 1/1988 |
| EP | 0730064 | A1 | 9/1996 |
| EP | 1452645 | A1 | 9/2004 |
| EP | 2586962 | A1 | 5/2013 |
| EP | 2685007 | A1 | 1/2014 |
| JP | H05-280042 | A | 10/1993 |
| JP | 2018-053649 | A | 4/2018 |
| KR | 10-1664366 | B1 | 10/2016 |
| WO | 2012/007533 | A1 | 1/2012 |

OTHER PUBLICATIONS

An Office Action mailed by the Korean Intellectual Property Office dated Aug. 31, 2020, which corresponds to Korean Patent Application No. 10-2019-0045178 and is related to U.S. Appl. No. 16/383,708 with English language translation.

An Office Action mailed by the Korean Intellectual Property Office dated Mar. 27, 2021, which corresponds to Korean Patent Application No. 10-2019-0045178 and is related to U.S. Appl. No. 16/383,708; with English language translation.

An Office Action mailed by National Intellectual Property Administration, P. R. China dated Mar. 4, 2021, which corresponds to Chinese Patent Application No. 201910312717.2 and is related to U.S. Appl. No. 16/383,708; with English language translation.

* cited by examiner

TRENCH CUTTER AND METHOD FOR PRODUCING A CUT TRENCH IN THE SOIL

The invention relates to a trench cutter for producing a cut trench in the soil with a cutter frame, at least one pair of cutting wheels which are supported and driven in a rotatable manner on the cutter frame, wherein each cutting wheel has a plurality of cutting teeth along its external circumference, and a discharge means with at least one discharge pump for discharging a cutting fluid from the cut trench in the region of the cutting wheels, in accordance with the preamble of claim 1.

Furthermore, the invention relates to a method for producing a cut trench in the soil with such a trench cutter, wherein in a cutting operation the cutting wheels are driven in a rotating manner and the trench cutter is sunk into the soil and soil material is cut off, wherein the cut trench is produced in the soil, in accordance with the preamble of claim 11.

Trench cutters of such type are used for producing so-called diaphragm walls or cut-off walls that are required e.g. for securing or sealing construction pits. By means of a trench cutter a first cut trench is produced which is filled with a hardenable mass. This mass hardens into a diaphragm wall segment. Through a sequence of several diaphragm wall segments it is thus possible to produce a diaphragm wall of a desired size.

From EP 1 452 645 A1 a trench cutter for producing a diaphragm wall in the soil can be taken. Between the two cutting wheel pairs a supply means opens out, by means of which a settable fluid can be introduced into the cut trench in the region between the cutting wheels. Through the rotating movement of the cutting wheels the supplied settable fluid is mixed with the cut-off soil material to a hardenable mass which can then harden into the diaphragm wall segment. In this known method the cut-off soil material is mixed to the hardenable mass directly in-situ in the cut trench.

Another method for producing a diaphragm wall segment in the soil can be taken from DE 41 41 629 A1. In the trench cutter employed for this purpose a discharge means is provided between the cutting wheels, with which the cut-off soil material is directly sucked off above ground together with stabilizing fluid present in the cut trench. The sucked-off slurry can be depleted of soil material in a separation means and returned to an upper region of the cut trench. In doing so, the slurry can be treated such that this constitutes a hardenable mass which hardens in the cut trench into the diaphragm wall segment.

When producing a cut trench by means of a trench cutter there is the fundamental problem that during cutting in cohesive soils, i.e. for example in clay, slit, claystone etc., the soil stripped by the cutting wheels adheres to the cutting teeth of the cutting wheels and can thus clog up the cutting wheels. This can have the effect that the clogging-up is of such gravity that the trench cutter has to be withdrawn from the cut trench in order to clean the cutting wheels mechanically. Due to the fact that cut trenches can reach a depth of 80 meters and more this constitutes high expenditure of time and therefore an economic drawback. As a result, the daily cutting performance of a trench cutter can be reduced significantly.

To loosen adhering soil material between annular rows of cutting teeth on a cutting wheel it is known from EP 2 685 007 A 1 for example that on the cutting wheel frame so-called reamer plates are mounted that project into the spaces between the annular rows of cutting teeth. However, the reamer plates have to keep a certain distance to the cutting wheels and the cutting teeth so that only a partial removal of adhering soil material can be achieved thereby.

From the generic EP 0 730 064 A1 a trench cutter can be taken, in which an injection means for injecting a fluid to the cutting teeth of the cutting wheel is provided directly on the discharge means.

The invention is based on the object to provide a trench cutter and a method for producing a cut trench in the soil, with which a cut trench can be produced in a particularly efficient manner.

In accordance with the invention the object is achieved by a trench cutter having the features of claim 1 or alternatively by a method having the features of claim 11. Preferred embodiments of the invention are stated in the respective dependent claims.

The trench cutter according to the invention is characterized in that a switchover means is provided which is designed for switching the discharge means over to a flushing operation, in which a fluid flow generated by at least one discharge pump of the discharge means is generated onto at least one cutting wheel for flushing out the cutting wheel.

A basic idea of the invention resides in the fact that the discharge means for discharging the cutting fluid, i.e. the cut-off soil material with the surrounding stabilizing fluid, is used at least partially for generating a fluid flow that is directed onto one cutting wheel, preferably onto all cutting wheels, in order to flush these free from adhering soil material. For this, a switchover means is provided, with which the discharge means can be switched over to a flushing operation. Through this the constructional and mechanical effort on a trench cutter can be kept at a minimum whilst accomplishing a good and reliable flushing-out of the cutting wheels at the same time.

A preferred embodiment of the invention resides in the fact that at least one discharge pump is designed as an adjustable pump which can be adjusted from a cutting operation, in which the discharge pump sucks off cutting fluid from the cutting wheels, to the flushing operation, in which the discharge pump conveys fluid in the reverse direction to the cutting wheels. The adjustable pump is also referred to as a so-called bidirectional pump that is capable of reversing the conveying direction. The switchover means is substantially an electric or electronic control means for changing the pump setting. This embodiment is particularly simple from a constructional viewpoint.

An advantageous further development resides in the fact that the discharge means has a discharge line which extends upwards from the at least one discharge pump, and that the switchover means comprises a positioning valve on the discharge line, wherein a suction opening on the discharge line is opened with the positioning valve. By way of the positioning valve ensurance is made in the first instance that the discharge line is blocked in the upward direction and material already conveyed upwards is not conveyed back downwards again from the discharge line. In the normal cutting operation the discharge line substantially serves to pump the cut-off soil material together with stabilizing fluid as a slurry in the upward direction, in particular above ground, in which case the cutting fluid can be filtered and treated in order to be then fed back into the trench.

In a second function a suction opening is formed by the positioning valve above the discharge pump. In this way, cutting fluid in the trench, which is not or only scarcely mixed with cut-off soil material, can be sucked in and conveyed by the switched-over discharge pump to the cutting wheels. Thus, a conservation of the pump is achieved.

According to a further development of the invention it is advantageous that two pairs of cutting wheels are provided, that a suction element of the discharge means is arranged in a center between the two cutting wheels and that in the flushing operation fluid flows from the suction element in the direction of the cutting wheels. By preference, the cutting wheels are supported in a rotatable manner about a joint axis of rotation. In the cutting operation the axis of rotation is in particular arranged horizontally. The axes of rotation of the two pairs are arranged in parallel or on the same axis. The discharge means is arranged in the center between the two cutting wheels so that the cutting fluid can be discharged centrally and in the flushing operation can then be supplied centrally.

Another preferred embodiment variant of the invention resides in the fact that a flushing line arrangement with at least one flushing outlet for flushing out the at least one cutting wheel is provided. Hence, in this embodiment a specific flushing line arrangement with at least one flushing outlet is provided in addition to or instead of the existing discharge line. By preference, on all cutting wheels at least one flushing outlet, preferably several flushing outlets are provided. In this way, a central incident flow does not have to take place, or not solely, during flushing via the switched-over suction element. In fact, a flushing line arrangement with a specific number of flushing outlets can be provided selectively.

In this connection it is especially preferred that the switchover means comprises a switchover valve which connects a discharge line of the discharge means to the flushing line arrangement in the flushing operation. In such an arrangement the discharge pump can keep its usual conveying direction of the cutting operation. Through the switchover valve the upward-directed conveying flow in the discharge means can be diverted to the flushing line arrangement which then leads the fluid flow in the downward direction. This embodiment variant is particularly simple and robust.

According to a further development of the invention a particularly good flushing performance is accomplished in that at least one second pump is provided which conveys fluid via the flushing line arrangement to the at least one cutting wheel in the flushing operation. By means of the at least one second pump or by means of several pumps an especially intensive flushing flow can be generated, with which adhering soil material is flushed out from the cutting wheels in a particularly reliable manner.

An especially advantageous embodiment variant is thereby achieved in that the second pump is attached to the discharge line and in the cutting operation conveys cutting fluid away in the upward direction and in that in the flushing operation the second pump is connected via an adjustment valve of the switchover means to the flushing line arrangement.

In the cutting operation the second pump can thus assist in conveying-away of cut-off soil material in the upward direction through the discharge line. In the flushing operation the second pump can be selectively used for flushing-out, in which case this is achieved by a corresponding adjustable or bidirectional pump or solely by an adjustment valve.

According to a further development of the invention a particularly good flushing-out is furthermore accomplished in that several flushing outlets are provided which are arranged in a fan-shaped manner in the region of the at least one cutting wheel. Especially when cutting off cohesive soils use is made of cutting wheels, in which the cutting teeth are arranged in annular cutting teeth rows that are axially offset to each other on the external circumference of a cutting wheel. Between the annular cutting teeth rows annular spaces are formed, into which the nozzle-like flushing outlets are directed. The flushing outlets can have one or several nozzle openings so that targeted nozzle jets can be directed onto the cutting teeth and in particular onto the spaces between the cutting teeth rows. Thereby, a plurality of flushing outlets can be provided in a fan-shaped manner according to the number of annular spaces.

In a simple embodiment the flushing outlets can be stationary. Especially for the setting to adapt to altered soils and tooth arrangements it is preferred in accordance with a further development of the invention that the at least one flushing outlet is designed as an adjustable nozzle. For instance, a ball-type nozzle can be provided which can be clamped in a set position by means of a corresponding union nut.

The method according to the invention is characterized in that in a flushing operation the trench cutter is raised and the cutting wheels are spaced from a cutting base of the soil and in that in the raised position of the cutting wheels a fluid flow is generated in the direction of the cutting wheels for flushing-out. The method can be carried out in particular with the previously described trench cutter according to the invention. The advantages described beforehand can be achieved.

To interrupt the cutting operation the cutter is raised and thereby spaced from the in-situ cutting base. This alone causes an interruption of the cutting operation. Subsequently, in the flushing operation, especially on further rotation of the cutting wheels, the fluid flow can be generated towards the cutting wheels, whereby the cutting wheels are flushed free from adhering soil material.

For retraction of the trench cutter it is particularly preferred that on an upper end of the trench cutter a rope or a bar is fixed, with which the trench cutter is suspended and adjusted vertically on a carrier implement. Through this an efficient lifting movement of the trench cutter can be brought about.

Moreover, according to an embodiment variant of the method pursuant to the invention it is of advantage that by means of a control means an injection pressure and/or an injection quantity of the fluid for flushing out the cutting wheels are set in the flushing operation. In particular, the flushing-out can be effected with an increased pressure lying between 2 bar and 40 bar. In principle, higher pressures can also be set depending on the soil material to be cut. By setting the injection pressure and/or injection quantity a cleaning of the cutting wheels can be accomplished in a most efficient way.

The result of flushing-out can be determined and verified by the control means through ascertainment of the change of the required driving power of the cutting wheels.

By way of the control means it is also possible to transfer free driving power of the cutting wheels to the at least one pump in the flushing operation.

Figure 2:
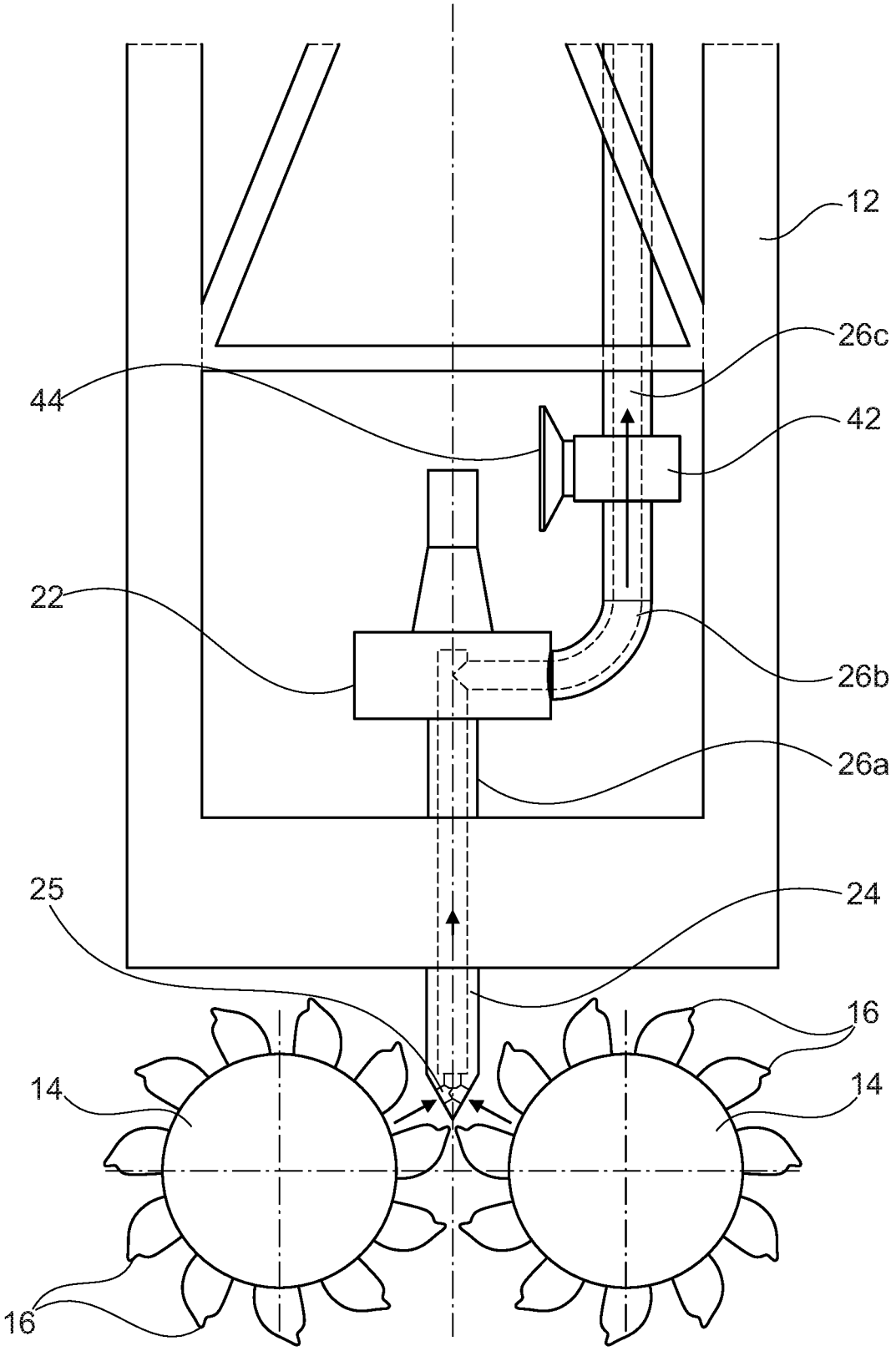
Figure 3:
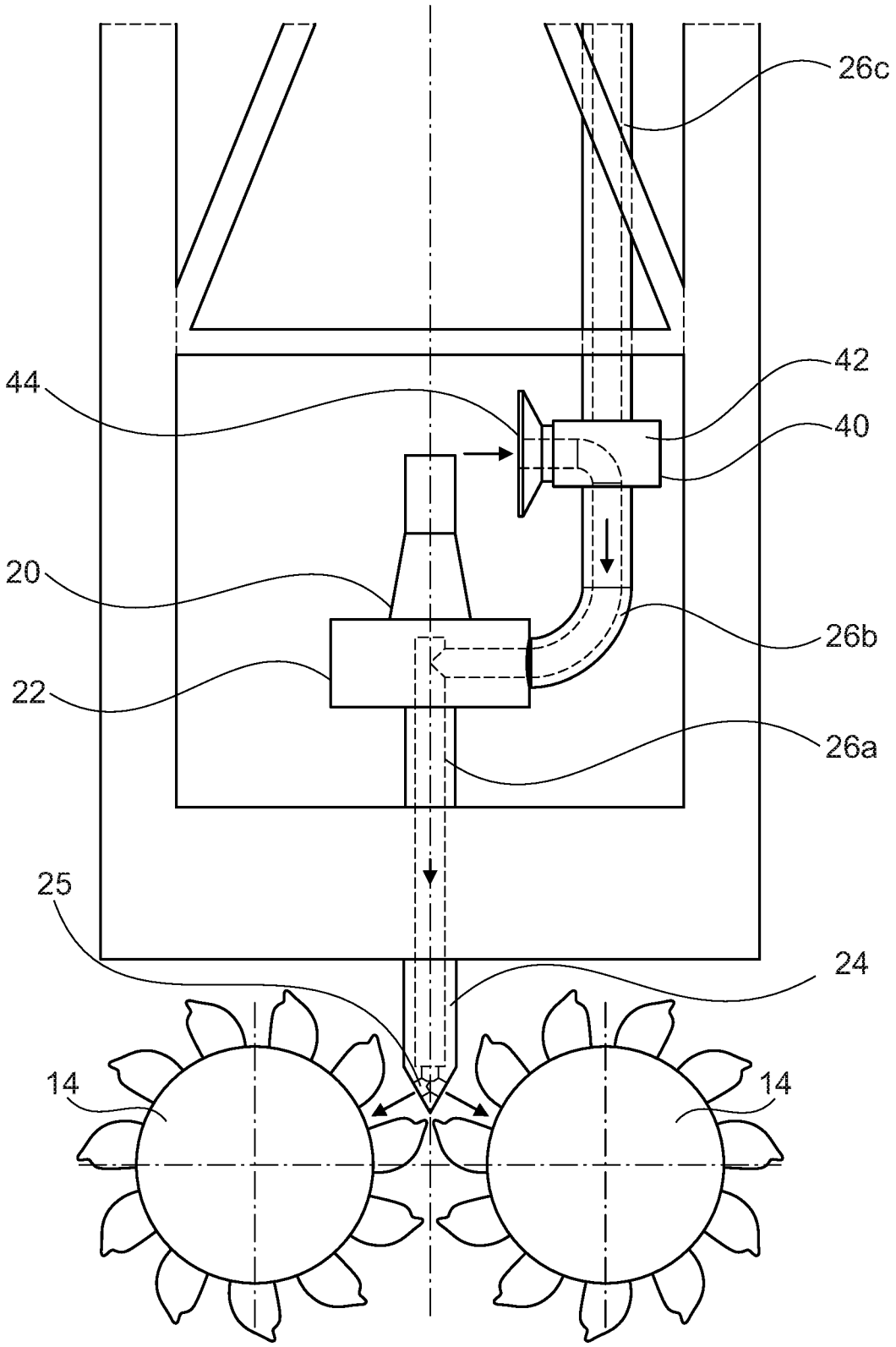
Figure 4:
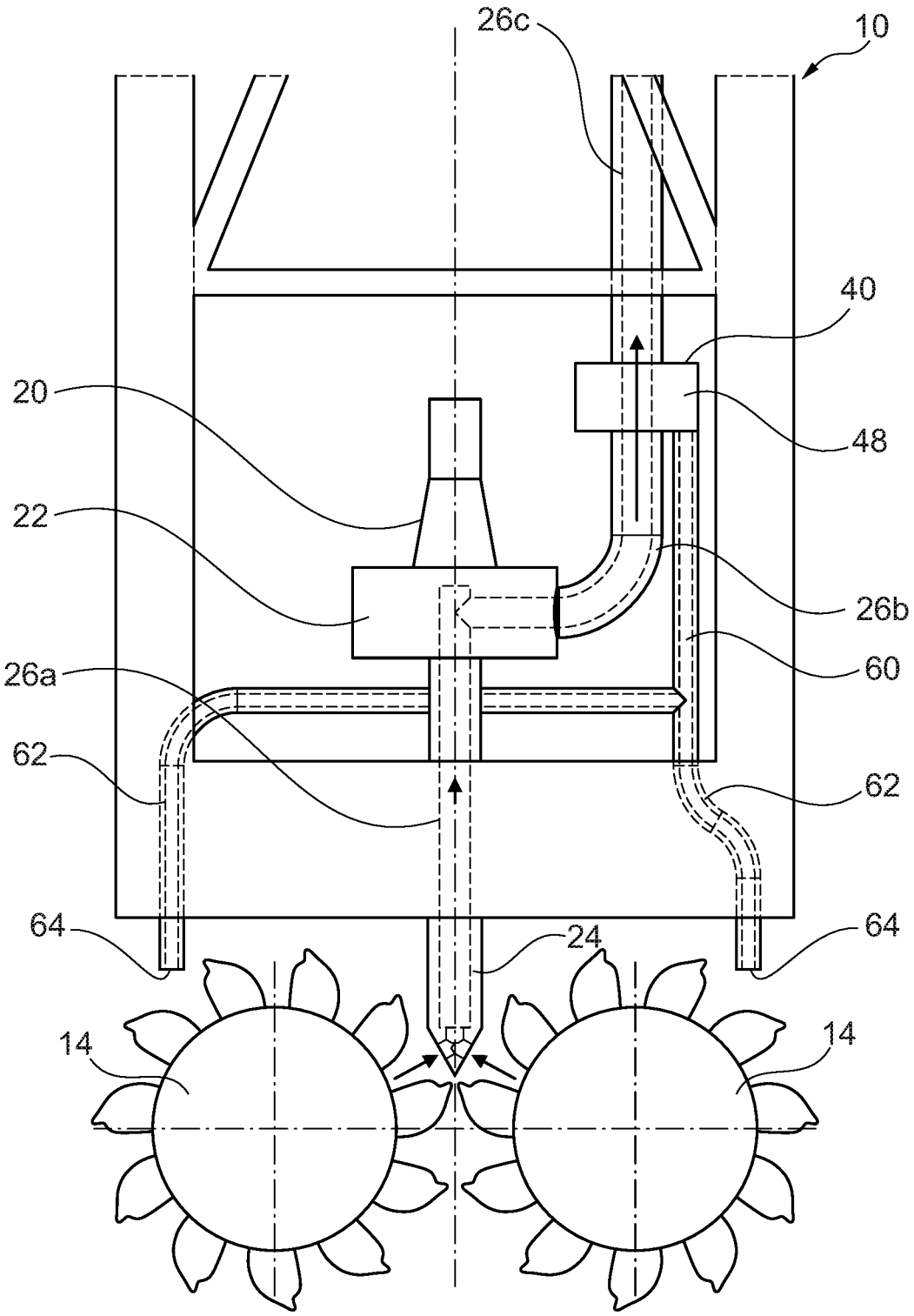
Figure 5:
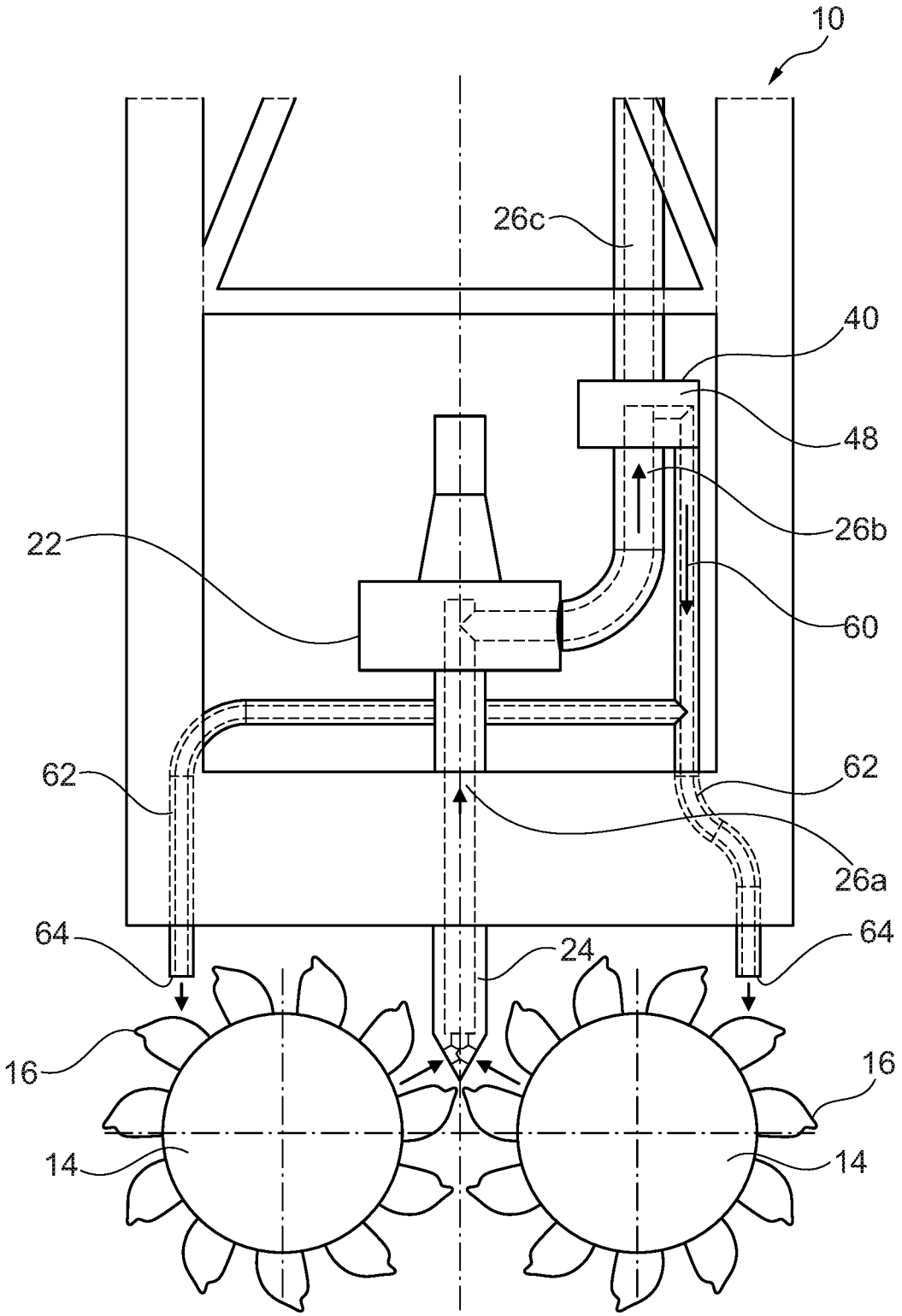
Figure 6:
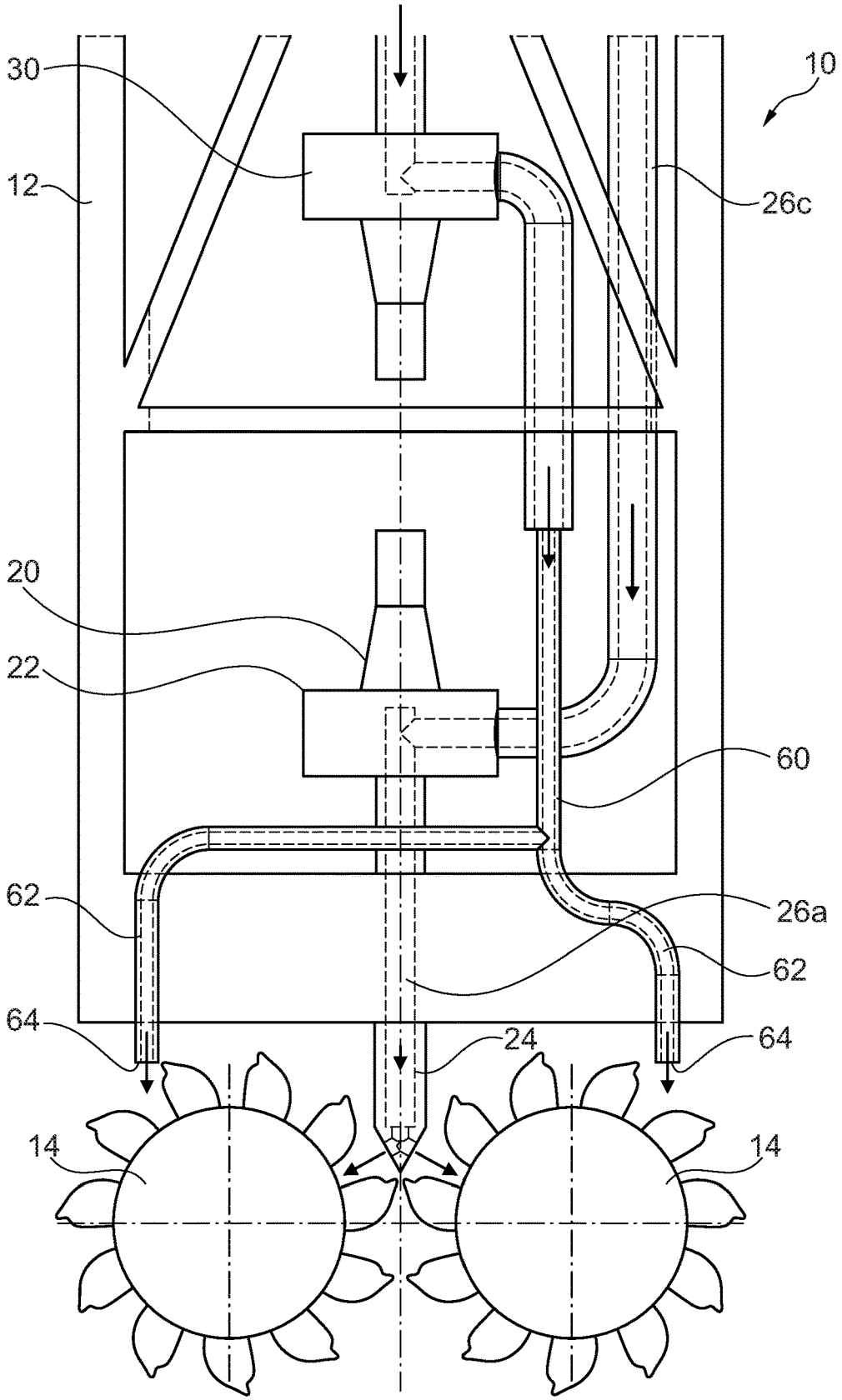
Figure 7:
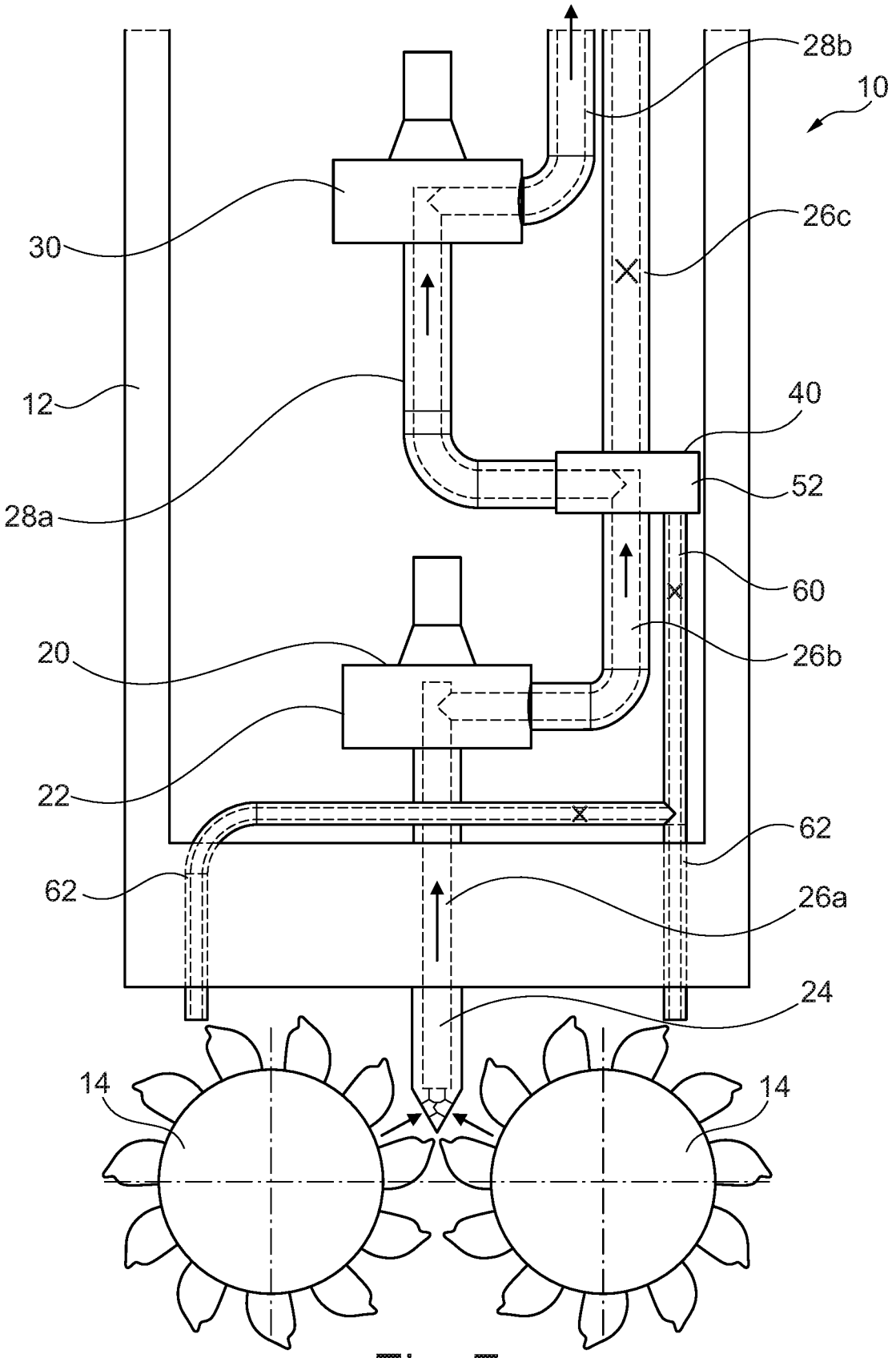
Figure 8:
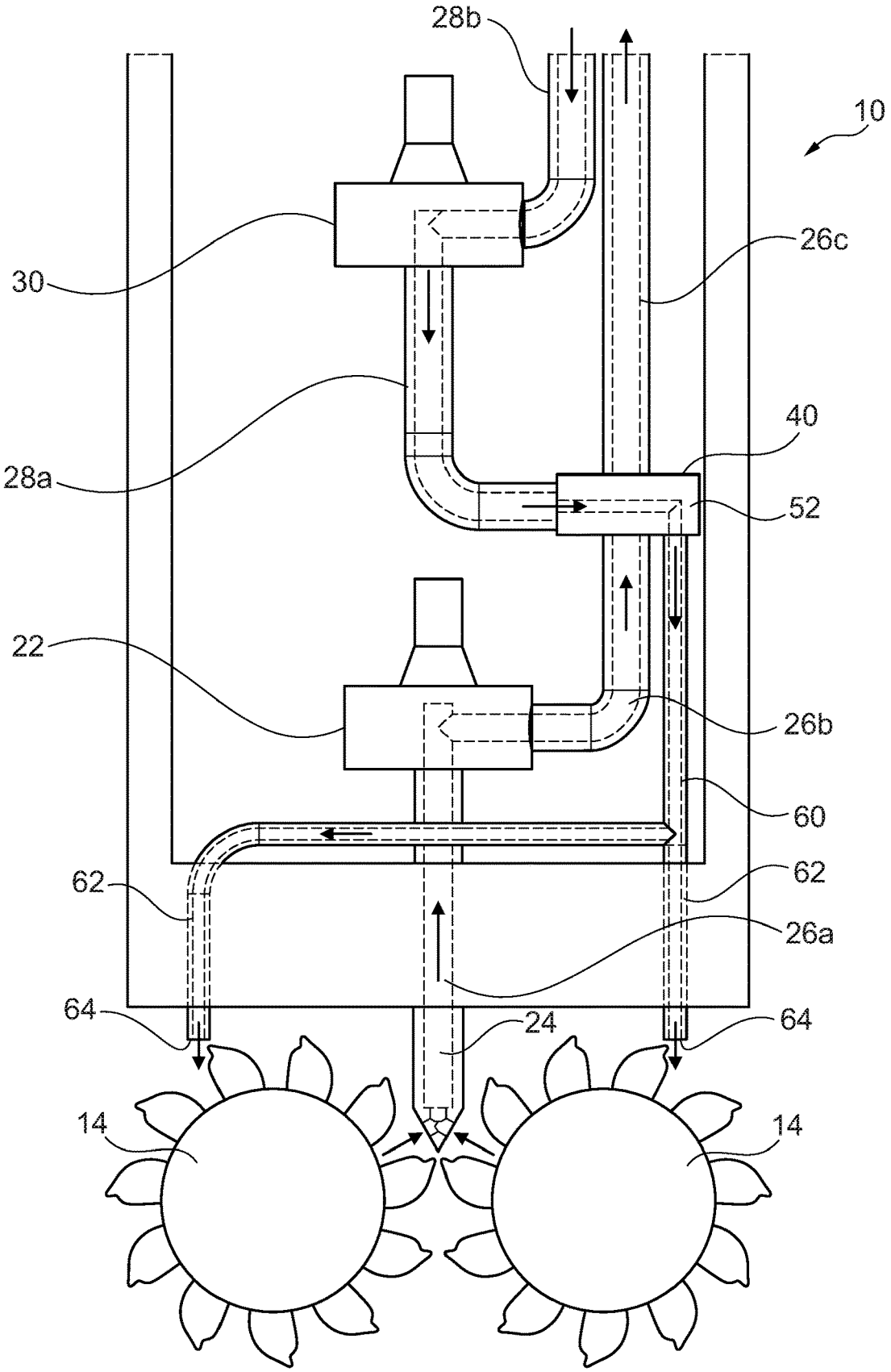

In the following the invention is set out in greater detail by way of preferred embodiments illustrated schematically in the drawings, wherein show:

FIG. 1 a schematic front view of a first trench cutter according to the invention;

FIG. 2 an enlarged detailed view of the trench cutter of FIG. 1 in a cutting operation;

FIG. 3 a view of the trench cutter of FIG. 2 in a flushing operation;

FIG. 4 a schematic view of a further trench cutter according to the invention in the cutting operation;

FIG. 5 a view of the trench cutter of FIG. 4 in a flushing operation;

FIG. 6 a schematic view of a third trench cutter according to the invention in a flushing operation;

FIG. 7 a schematic view of a fourth trench cutter according to the invention in the cutting operation and FIG. 8 a view of the trench cutter of FIG. 7 in the flushing operation.

FIG. 1 shows an overall view of a trench cutter 10 according to the invention with a box-like cutter frame 12, at the lower end of which two pairs of cutting wheels 14 are arranged. By way of a drive motor, not depicted, the cutting wheels 14 can be driven in a rotating manner about horizontal axes of rotation that are parallel to each other. On the external sides of the drum-shaped cutting wheels 14 releasable cutting teeth 16 are arranged in a known manner via plate-shaped holders, with which in-situ soil material can be cut off at the base of the trench in the cutting operation. In the cutting operation the cut trench is filled with a stabilizing fluid not shown in FIG. 1. Together with surrounding stabilizing fluid the cut-off soil material is sucked off as cutting fluid via a suction element 24 of a discharge means 20, which is arranged centrally between the cutting wheels 14.

Via a lower discharge line 26*a* the suction element 24 is connected to a discharge pump 22 of the discharge means 20, which is arranged on the frame. The discharge pump 22 generates the suction pressure for sucking the cutting fluid in. Via the discharge pump 22 the sucked-in cutting fluid is then removed further upwards via an upper discharge line 26*c* from the cut trench. The cutting fluid can be treated above ground in a corresponding facility, in particular being depleted of cut-off soil material. The treated cutting fluid can then be returned as stabilizing fluid into the trench.

At the upper end of the cutter frame 20 a holding means 18 is arranged. With the holding means 18 the trench cutter 10 can be fixed on a rope or a guide bar of a carrier implement, not shown in greater detail, and through this displaced vertically in particular. The trench cutter 10 illustrated in FIG. 1 has, by way of example, a box-shaped cutter frame 12 that is provided with lateral guide elements. Through this the trench cutter 10 is able to guide itself in the trench. Alternatively, the cutter frame 12 can also be designed in a compact way and substantially without guide elements for contact guidance. In this case guidance takes place from the outside of the cut trench by the carrier implement via a guide bar fixed on the holding means 18.

In the cutting operation, in particular when cutting off cohesive soil material, this can adhere to the cutting teeth 16 with the plate-shaped holders on the cutting wheels 10. As a result, the cutting performance of the trench cutter 10 can be markedly reduced. To counteract clogging-up of the cutting wheels 14 by adhering soil material the trench cutter 10 is provided in accordance with the invention with a switchover means 40, with which, in the illustrated embodiment, the trench cutter 10 can be switched from a cutting operation over to a flushing operation for flushing out the cutting wheels 14.

In the first embodiment of a trench cutter 10 according to the invention illustrated in FIGS. 1 to 3 the switchover means 40 has a positioning valve 42 between a middle discharge line 26*b* and the upper discharge line 26*c* of the discharge means 20. Through the positioning valve 42 the upper discharge line 26*c* lying above the positioning valve 42 is blocked and at the same time a suction opening 44 on the positioning valve 42 is cleared. The suction opening 44 is preferably located above the discharge pump 22 in an upper region of the cutter frame 12 that is spaced from the cutting wheels 14.

Furthermore, in the embodiment according to FIGS. 1 to 3 the discharge pump 22 is designed as an adjustable pump, also referred to as a bidirectional pump. Simultaneously with the actuation of the positioning valve 42 the discharge pump 22 is changed over in its conveying direction. Thus, on opening the suction opening 44 the discharge pump 22 is switched over from a cutting operation, in which the discharge pump 22 conveys cutting fluid from the cutting wheels 14 in the upward direction, as illustrated graphically with arrows in FIG. 2, to a flushing operation according to FIG. 3.

In the cutting operation according to FIG. 2 cutting fluid is sucked in via the central suction element 24 with openings 25 and pumped upwards via the discharge line 26. In this cutting operation the suction opening 44 is closed by the positioning valve 42. On switching over to the flushing operation according to FIG. 3 the changed-over discharge pump 22 causes cutting fluid to be sucked in through the opened suction opening 44 from an upper region of the cut trench and conveyed via the middle discharge line 26*b* and the lower discharge line 26*a* to the cutting wheels 14. In doing so, the fluid exits with a settable pressure and a settable conveying quantity via the openings 25 of the suction element 24 in both directions towards the cutting wheels 14. The setting can take place via a control means in the carrier implement. In this flushing operation the trench cutter 10 is raised so that the cutting wheels 14 are spaced from the in-situ trench base. On continued rotation of the cutting wheels 14, which rotate, in particular, in opposed directions so that the cutting teeth 16 move from below towards the suction element 24, adhering soil material is loosened on the external side of the cutting wheels 14 by the outflowing fluid. After flushing-out a switch-back to the cutting operation can be effected by the control means, in which case the cutter is then lowered back onto the trench base in order to cut off further soil material.

In FIGS. 4 and 5 a second embodiment of a trench cutter 10 according to the invention is shown. FIG. 4 shows the trench cutter 10 in the cutting operation, in which the trench cutter 10 functions according to the previously described first embodiment. Soil material stripped off by the cutting wheels 14 is sucked off by the discharge means 20 with the discharge pump 22 via the suction element 24 and is conveyed away upwards.

In this second embodiment of a trench cutter 10 according to the invention the conveying direction of the discharge pump 22 remains unchanged in the flushing operation illustrated schematically in FIG. 5. In the second embodiment the switchover means 40 has a switchover valve 48. When switching over to the flushing operation the switchover valve 48 blocks the upper discharge line 26*c* of the discharge means 20 and connects the middle discharge line 26*b* to a flushing line arrangement 60. The flushing line arrangement 60 has one or several flushing lines 62 which lead from the switchover valve 48 in the downward direction to the cutting wheels 14. The flushing lines 62 end in nozzle-like flushing outlets 64, with which the cutting fluid conveyed by the discharge pump 22 is fed back to the cutting wheels 14 in the region of the cutting teeth 16 in order to loosen adhering soil material. Hence, in this second embodiment a simple discharge pump 22 can still be used.

A third embodiment of a trench cutter 10 according to the invention is shown in FIG. 6 in a flushing operation. In the cutting operation, not depicted, the trench cutter 10 according to FIG. 6 functions like the two embodiment variants described beforehand. Together with surrounding fluid soil material stripped by the cutting wheels 14 is sucked in via the suction element 24 by a discharge pump 22 of a discharge means 20 and discharged via a lower discharge line 26*a* in the upward direction via an upper discharge line 26*c*.

In the flushing operation according to FIG. 6 the discharge pump 22 is changed over in its conveying direction in line with the first embodiment according to FIGS. 1 to 3. Hence, the discharge pump 22 is also designed as an adjustable or bidirectional pump. Via the discharge line 26 fluid from an upper region of the trench or from the treatment facility itself is then flushed via the discharge pump 22 and the suction element 24 back towards the cutting wheels 14. To assist flushing-out provision is made in the third embodiment of a trench cutter 10 according to the invention for a second pump 30 on the cutter frame 12. In the flushing operation this second pump 30 can additionally convey fluid via a flushing line arrangement 60 with several flushing lines 62 and flushing outlets 64 in the direction of the cutting wheels 14 and flow adhering soil material loose. In this embodiment a flushing-out therefore takes place both from the direction of the suction element 24 and by additional flushing outlets 64 of the flushing line arrangement 60.

A fourth embodiment of a trench cutter 10 according to the invention is illustrated in FIGS. 7 and 8. The trench cutter 10 according to FIG. 7 is thereby in the cutting operation, in which, similar to the previously described embodiments, soil material cut off by the cutting wheels 14 is sucked in together with fluid via the suction element 24 by a discharge pump 22 of a discharge means 20 and conveyed away upwards via a lower, middle and upper discharge line 26*a, b, c*. In addition, between the middle discharge line 26*b* and the upper discharge line 26*c* a second pump 30 is attached via a lower additional line 28*a* and an adjustment valve 52 of a switchover means 40 according to the invention. In the cutting operation conveying-away of the sucked-in cutting fluid can therefore be effected not only via the discharge pump 22 but also via the second pump 30 that conveys the sucked-in cutting fluid away in the upward direction via the upper additional line 28*b*. In this way, particularly high conveying rates can be reached, as is especially advantageous in the case of deep cut trenches. In this double-pump arrangement the upper discharge line 26*c* is blocked by the adjustment valve 52 in the cutting operation.

Via the adjustment valve 52 of the switchover means 40 the additional line 28 can be connected to a flushing line arrangement 60 with flushing lines 62. In the cutting operation according to FIG. 7, however, there is no line connection between the additional line 28 and the flushing line arrangement 60.

On switching over to a flushing operation according to FIG. 8 the adjustment valve 52 connects the additional line 28 of the second pump 30 to the flushing line arrangement 60. At the same time, the second pump 30 which is designed as an adjustable pump is changed over in its conveying direction by the switchover means 40. This enables the second pump 30 to feed fluid via the additional line 28 from above to below into the flushing line arrangement 60 that leads to the cutting wheels 14. Via corresponding flushing outlets 64 at the end of the flushing lines 62 a targeted incident flow onto an external side of the cutting wheels 14 can be effected to flush out adhering soil material.

At the same time, the adjustment of the adjustment valve 52 disconnects the line connection between the middle discharge line 26*b* from the discharge pump 22 to the additional line 28. Moreover, in the position for the flushing operation according to FIG. 8 the adjustment valve 52 connects the lower discharge line 26*a* and the middle discharge line 26*b* to the upper discharge line 26*c* so that the discharge pump 22 still sucks in cutting fluid from the region of the cutting wheels 14 that preferably continue rotating. Through this, in particular loosened soil material from the cutting wheels 14 can be directly sucked in by the suction element 24 and conveyed away upwards via the discharge line 26.

Especially with the trench cutter 10 according to the fourth embodiment pursuant to FIGS. 7 and 8 a cleaning and flushing-out of the cutting wheels 14 can also take place during ongoing cutting operation.

The invention claimed is:

1. A trench cutter for producing a cut trench in the soil, the trench cutter comprising:

a cutter frame, at least one pair of cutting wheels which are supported and driven in a rotatable manner on a lower end of the cutter frame, wherein each cutting wheel has a plurality of cutting teeth along its external circumference, a discharge means with at least one discharge pump for discharging a cutting fluid from the cut trench in the region of the cutting wheels, a switchover means, and a suction opening located above the at least one discharge pump and the cutting wheels in an upper region of the cutter frame that is spaced apart from the cutting wheels, wherein the switchover means is configured to switch the discharge means over to a flushing operation, in which a fluid flow generated by the at least one discharge pump of the discharge means is generated onto at least one cutting wheel for flushing out the cutting wheel, and during the flushing operation, the fluid is suctioned through the suction opening.

2. The trench cutter according to claim 1, wherein at least One discharge pump is designed as an adjustable pump which can be adjusted from a cutting operation, in which the discharge pump sucks off cutting fluid from the cutting wheels, to the flushing operation, in which the discharge pump conveys fluid in the reverse direction to the cutting wheels.

3. The trench cutter according to claim 1, wherein the discharge means has a discharge line which extends upwards from the at least one discharge pump, and in that the switchover means comprises a positioning valve on the discharge line, wherein a suction opening on the discharge line is opened with the positioning valve.

4. The trench cutter according to claim 1, wherein two pairs of cutting wheels are provided, in that a suction element of the discharge means is arranged in a center between the two cutting wheels and in that in the flushing operation fluid flows from the suction element in the direction of the cutting wheels.

5. The trench cutter according to claim 1, wherein a flushing line arrangement with at least one flushing outlet for flushing out the at least one cutting wheel is provided.

6. The trench cutter according to claim 5, wherein the switchover means comprises a switchover valve which connects a discharge line of the discharge means to the flushing line arrangement in the flushing operation.

7. The trench cutter according to claim 5, wherein at least one second pump is provided which conveys fluid via the flushing line arrangement to the at least one cutting wheel in a flushing operation.

8. The trench cutter according to claim 7, wherein the second pump is attached to the discharge line and in the cutting operation conveys cutting fluid away in the upward direction and in that in the flushing operation the second pump is connected via an adjustment valve of the switchover means to the flushing line arrangement.

9. The trench cutter according to claim 5, wherein several flushing outlets are provided which are arranged in a fan-shaped manner in the region of the at least one cutting wheel.

10. The trench cutter according to claim 5, wherein the at least one flushing outlet is designed as an adjustable nozzle.

11. A method for cutting a cut trench in soil, the method comprising:

performing a cutting operation by driving cutting wheels in a rotating manner and sinking a trench cutter into the soil to cut off soil material;

producing the cut trench in the soil;

switching at least one discharge pump from being configured to discharge cutting fluid from the cut trench in a region of the cutting wheels to being configured to perform a flushing operation; and performing the flushing operation, wherein in the flushing operation, the trench cutter is raised and the cutting wheels are spaced from a cutting base of the soil, in the raised position of the cutting wheels, a fluid flow is generated in the direction of the cutting wheels for flushing out the cutting wheels, and during the flushing operation, the fluid is suctioned through a suction opening located above the at least one discharge pump and the cutting wheels, the suction opening being spaced apart from the cutting wheels.

12. The method according to claim 11, wherein on an upper end of the trench cutter a rope or a bar is fixed, with which the trench cutter is suspended and adjusted vertically on a carrier implement.

13. The method according to claim 11, wherein by means of a control means an injection pressure and/or an injection quantity of the fluid for flushing out the cutting wheels are set in the flushing operation.

* * * * *